United States Patent [19]

Burton

[11] 4,161,182

[45] Jul. 17, 1979

[54] SANITARY HOSE HOLDER

[76] Inventor: Richard J. Burton, 906 Seminole Rd., Waycross, Ga. 31501

[21] Appl. No.: 838,660

[22] Filed: Oct. 3, 1977

[51] Int. Cl.[2] ..... B08B 9/02

[52] U.S. Cl. ..... 134/166 C; 15/304; 15/406; 138/106; 138/178; 248/75

[58] Field of Search ..... 134/22 C, 149, 166 C, 134/167 C, 168 C, 169 C; 138/106, 108, 178; 15/304, 313, 315, 406; 248/75; 211/60 R

[56] References Cited

U.S. PATENT DOCUMENTS

| | | | |
|---|---|---|---|
| 1,893,979 | 1/1933 | Barrere | 134/166 C X |
| 2,791,227 | 5/1957 | Holmstrom | 134/169 C |
| 3,992,221 | 11/1976 | Homsy | 134/22 R |
| 4,054,149 | 10/1977 | Nelson | 134/149 X |

*Primary Examiner*—Robert L. Bleutge
*Attorney, Agent, or Firm*—George H. Baldwin; Arthur G. Yeager

[57] ABSTRACT

An extensible sanitary hose used for the transfer of sewage from a holding tank to a sanitary facility may be cleaned and stored by the use of a combination holding and cleaning device which is fabricated from an elongated hollow cylinder having a number of openings extending laterally therethrough distributed along its length, such cylinder being open at one end and closed at the other end. A circular retaining member is mounted to the cylinder adjacent its closed end for supporting the bottom end of the hose for restraining the hose in place thereon, and a locking ring is removably mounted to the cylinder adjacent its open end.

10 Claims, 5 Drawing Figures

SANITARY HOSE HOLDER

BACKGROUND OF THE INVENTION

1. Field of the Invention

This invention relates to a device for holding and cleaning extensible sanitary hoses.

Over a period of years, the number of personal motorized transport vehicles, such as motor homes, travel trailers, and the like, has increased dramatically. Among the many reasons for the increase in popularity of such vehicles is the fact that they provide an almost totally self-contained living unit for their passengers, including facilities for cooking, sleeping, and eating. Also included in many such units are bathroom facilities having a toilet fixture for the convenience of the passengers. While such toilet facilities may vary widely in function and design, each must include a waste holding tank which acculates the solid and liquid wastes from the toilet fixture until such time as the wastes may be transferred to a suitable sanitary facility.

In order to transfer the solid and liquid wastes from the holding tank to the sanitary facility, an extensible sanitary hose is included as a part of the vehicle equipment with the hose being used to connect the holding tank to the facility. After the waste transfer operation is completed, however, the hose must be cleansed and disinfected in order to avoid the build-up of waste residues adhering to the interior of the sanitary hose and to avoid the bacterial and insect infestation which would result from such an accumulation. Once such cleansing and disinfecting are accomplished, the interior of the hose must be suitably dried in order to avoid possible degradation of the hose material as well as to avoid the build-up of mildew and other types of fungus. Once dried, the hose is then to be stored prior to reuse in such a way as to avoid physical damage to the hose structure.

2. Description of the Prior Art

The prior art found in the search relative to this invention is as follows: U.S. Pat. Nos. 985,801 to Heathcote; 1,579,796 to Shiels; 1,893,979 to Barrere; 2,726,180 to Stankey; 2,919,704 to Butler; 3,897,599 to Artzer; and 3,992,221 to Homsy et al. None of these patents either alone or in appropriate combinations disclose a sanitary hose holder in accord with this invention.

A general object of this invention is to provide an improved sanitary hose holder.

A particular object of this invention is to provide a holder for the efficient and effective cleaning of the interior of an extensible sanitary hose detachably mounted thereon.

Another particular object of this invention is the provision of an improved holder for a sanitary hose which will support the hose subsequent to cleaning in an orientation which will allow ventillation throughout the interior thereof.

A specific object of this invention is to provide a holder for cleaning and drying of an extensible sanitary hose which may be used to support the hose during storage such that physical damage thereto is minimized.

Additional objects relate to a hose holder which is simple and economical in construction, and durable and efficient in use.

SUMMARY

An improved holder substantially accomplishing the objective hereinabove stated may be fabricated from an elongated hollow cylinder having a plurality of openings along its length extending laterally therethrough, such cylinder being open at one end and closed at the other end. The cylinder is of a length greater than the length of a sanitary hose to be mounted thereon, and having an outside diameter less than the inside diameter of such sanitary hose. A retaining member is mounted to the cylinder adjacent its closed end and extend outwardly from the cylinder to a distance sufficient to stop the end of the sanitary hose, and a means for locking releasably mounted to the cylinder adjacent the open first end and extending outwardly from the cylinder to a distance sufficient to prevent passage of the sanitary hose thereover.

BRIEF DESCRIPTION OF THE DRAWINGS

The novel features which are believed to be characteristic of this invention are set forth with particularity in the appended claims. The invention itself, however, both as its organization and method of operation, together with further objects and advantages thereof, may best be understood by reference to the following description taken in connection with the accompanying drawings in which:

DESCRIPTION OF THE PREFERRED EMBODIMENT

Figure 1:
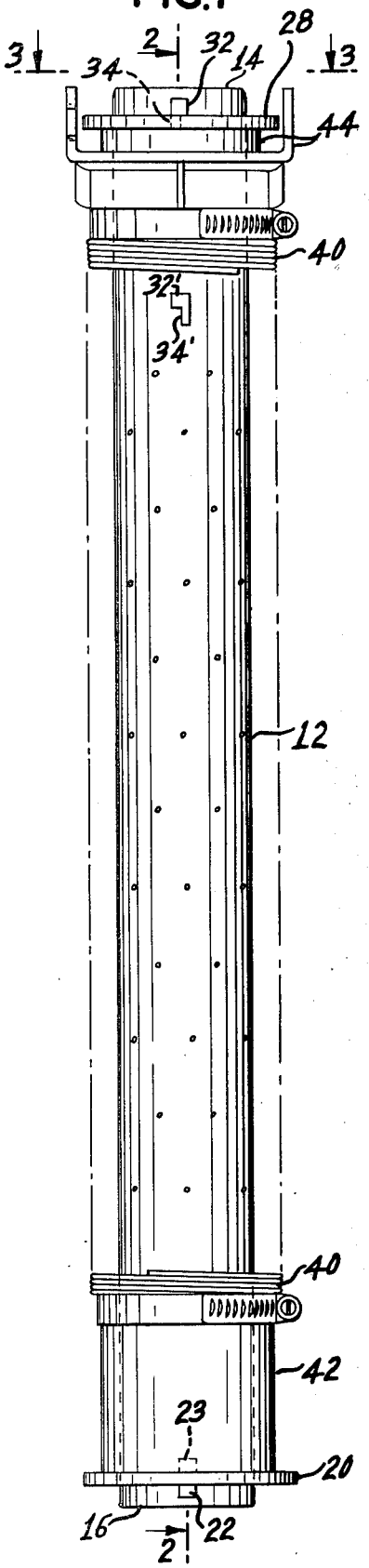
FIG. 1 is a side elevational view of the holder in accord with this invention.

Referring now more particularly to FIG. 1, a holding and cleaning device is indicated generally at 10 which comprises an elongated hollow cylinder 12 having an open top end 14 and a closed bottom end 16. Cylinder 12 may be fabricated from any suitable material, but is preferably fabricated from a rigid synthetic plastic, such as polyvinyl chloride or the like in order to maximize the strength-to-weight ratio and be resistant to corrosion or the like. Cylinder 12 is provided with a plurality of openings 18, extending therethrough and communicating within the interior hollow 19 thereof. Openings 18 may be distributed over the length of cylinder 12 in any desired fashion such that a diluted disinfecting fluid contained within cylinder 12 may pass therethrough to the exterior of cylinder 12 in a generally symetrical pattern.

Adjacent closed bottom 16 of cylinder 12, there is provided a circular retainer member in the form of a retainer ring 20 mounted to cylinder 12 adjacent lower closed end 16 thereof. Retainer ring 20 has an inside diameter slightly in excess of the outside diameter of cylinder 12 so that such ring will fit snugly thereabout. In addition retainer ring 20 has an outside diameter not less than the inside diameter of a sanitary hose or its connection such that such hose or connection will be stopped by retainer ring 20. Retainer ring 20 is maintained in its position adjacent closed bottom end 16 of cylinder 12 by retainer ring positioning means in the form of a plurality of tabs 22 generally parallel to and adjacent bottom end 16 and an upwardly spaced tab 23 with ring 20 being disposed therebetween. Retainer ring positioning means may also include other tabs or simply the ring 20 may be glued or otherwise affixed to cylinder 12.

A removable locking means in the form of locking ring 28 is removably attached about cylinder 12 adjacent open top end 14 thereof. Locking ring 28 has an inside diameter approximately equal to the outside diameter of cylinder 12, and has an outside diameter not less than the inside diameter of the sanitary hose or its attachment to be mounted on cylinder 12. In addition locking ring 28 has a plurality of grooves or notches 30 in the interior surface thereof. Locking ring tabs 32 are rigidly mounted to and extend radially outwardly from cylinder 12, and are so positioned with respect to each other as to define an upper plane which is substantially normal to the longitudinal axis of cylinder 12.

Figure 4:
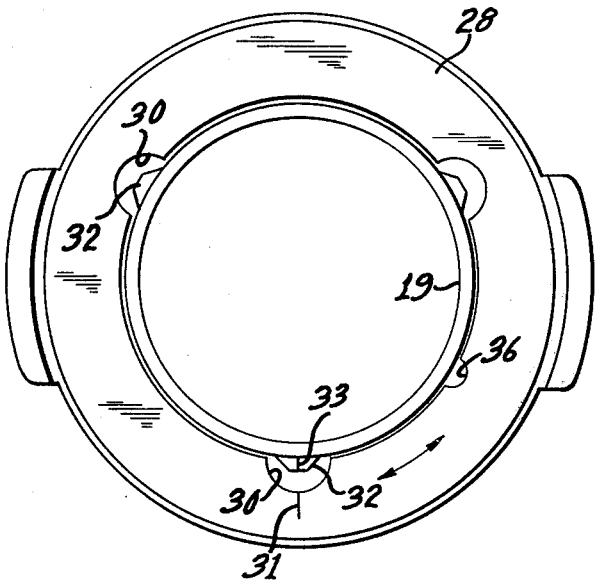
FIG. 4 is a view similar to FIG. 3 showing the locking means in an unlocked position.

Locking ring tabs 32 are sized and shaped and spaced about cylinder 12 as to be alignable with notches 30 of locking ring 28 such that ring 28 may be passed thereover with tabs 32 passing through notches 30. The angular relationship of the notches 30 and tabs 32 are identical but the angle between notches are unequal so that ring 28 must be angularly oriented, as by color keys 33 and 31 or the like on one tab and one groove, before ring 28 is in proper position illustrated in FIGS. 1 and 2. Once in proper angular position, as shown in FIG. 4, the ring 28 may be stabilized by turning ring 28 in a plane normal to the longitudinal axis of cylinder 12 such that notches 30 are offset from tabs 32. A small tab 34, which may be integral with one of the tabs 32 is disposed below the plane in which tabs 32 are located, preferably engages a small groove or notch 36, such notch being smaller than tab 32 so that the ring 28 will remain stopped in the longitudinal direction by tab 32 and stopped from angularly moving by tab 34 being engaged in notch 36.

Having described the construction of the combination holding and cleaning device for sanitary hoses, the operation and utility of the device will become clearer to those skilled in the art from consideration of the following description.

Figure 2:
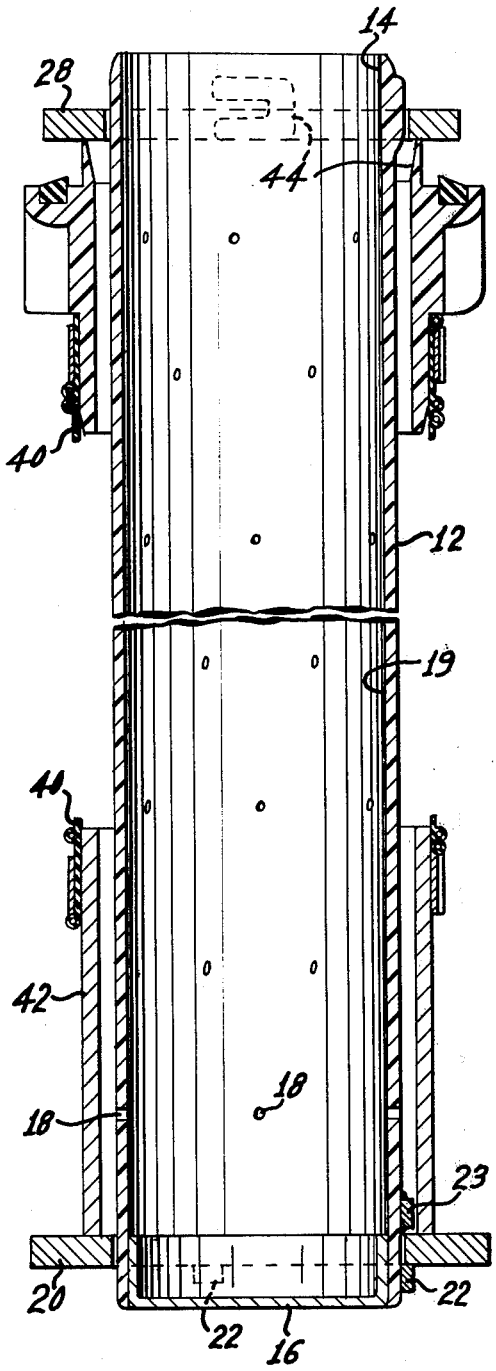
FIG. 2 is an enlarged cross-sectional view taken along line 2—2 of FIG. 1.
Figure 5:
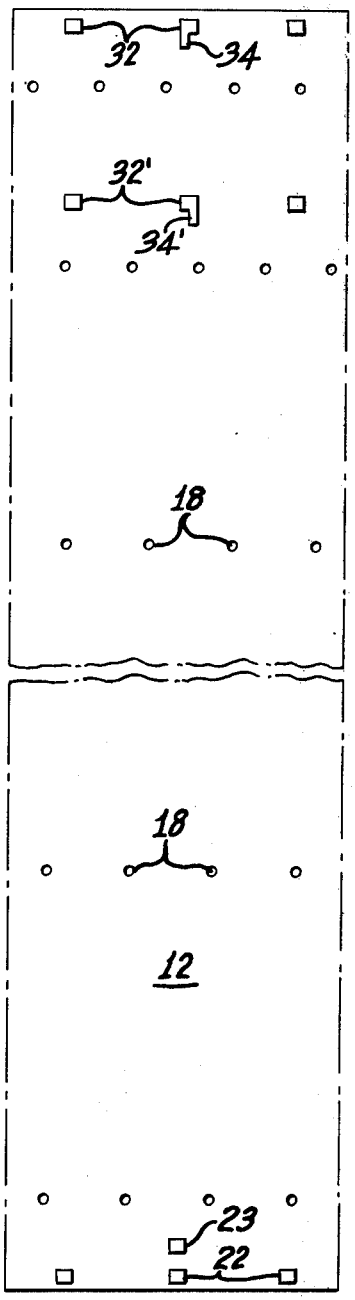
FIG. 5 is a flattened representation of the cylinder to illustrate the various stops and locking components thereof.
Figure 3:
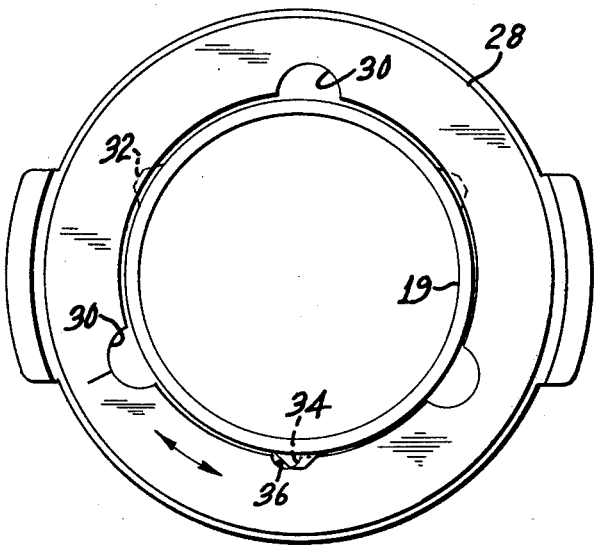
FIG. 3 is an enlarged end elevational view taken along line 3—3 of FIG. 1, showing the locking means in a locked position.

In operation, locking ring 28 is removed from cylinder 12 by pressing ring 28 downwardly, so that notch 36 and ring 28 clears tab 34, and rotating ring 28 so that notches 30 align with tabs 34, as illustrated in FIG. 4, thus permitting removal thereof. The lower end of the sanitary hose 40 or its lower connection 42 such that such end is juxtaposed with retaining ring 20 and the upper end of the sanitary hose 40 or its upper connection 44 is adjacent the open top end 14 of cylinder 12. Once cylinder 12 is so inserted into the sanitary hose 40, locking ring 28 is inserted over open top end 14, displaced downwardly along cylinder 12 with notches 30 aligned with tabs 32, such displacement preferably causing sanitary hose 40 to be temporarily compressed, then the locking ring is rotated, such that the notches 30 of locking ring 28 are rotated out of alignment with tabs 32, and until notch 36 is aligned with tab 34, whereupon the ring is displaced upwardly by the slightly compressed sanitary hose to lock such ring 28 to cylinder 12, as shown in FIGS. 1, 2 and 3.

Water, or other suitable cleansing liquid, perhaps containing a disinfectant such as an oxidizing agent like liquid bleach, is poured into the top open end 14 of cylinder 12 to a level and at a rate such that the liquid will fill cylinder 12 to a position above the top most openings 18 and even out of the top open end 14. As the level of the cleansing fluid exceeds the height of the various openings 18, the liquid will flow therethrough and, will contact the interior surface of the sanitary hose which ordinarily carry residual amounts of waste thereon. By virtue of the flow of the liquid, the residual waste will be washed or flushed free from the interior surface of the hose and, in the event that a disenfectant is included in the cleansing liquid, a layer of disenfectant/cleansing liquid will remain on the interior surface. Due to the non-sealing contact maintained between retainer ring 20 and the bottom connecting portion 42 of the sanitary hose 40, the liquid flowing over the interior surface of the sanitary hose will exit therefrom over the retainer ring 20 adjacent closed bottom end 16 of cylinder 12. Once the cleansing operation is completed to the satisfaction of the user, the remainder of the cleansing liquid trapped above closed end 16 of cylinder 12 may be poured therefrom through open top end 14. A user may wish to remove locking ring 28 and pick up the upper end 44 of hose 40 sufficiently so that lower end 42 is out of contact with retainer ring 20, thereby assuring that all the wastes and water are drained from the hose. Thereafter, the locking ring 20 is re-positioned to lock the hose onto cylinder 12.

In order to dry the interior of the sanitary hose, an air blast may be directed through open end 14 into cylinder 12 exiting therefrom through openings 18. This air flow contact between openings 18 and the interior of the sanitary hose will result in quick drying of the hose and will thereby inhibit the residual cleansing liquid from acting as a medium for the growth of fungus or the like. While such a method of drying would be optimal for use with the device, no such air blast is necessary due to the fact that there is free communication between the interior of the sanitary hose, the interior of hollow cylinder 12 and the ambient atmosphere. Thus, longer drying times are normally available to dry the interior surface of the hose by simply storing same and permitting evaporation to occur naturally.

Once the cleansing operation is completed, the sanitary hose may be stored in a mounted condition on the holding and cleaning device, so that abrasions and the like are inhibited from the exterior of the sanitary hose 40. Retaining ring 20 and locking ring 28 have an outside diameter in excess of that of the sanitary hose 40 and when the hose and device are inserted horizontally into a trailer storage tube or the like, or resting on a floor, the retaining ring 20 and locking ring 28 or hose connector 44 contacts the supporting surface and even a slight sag of the hose will not cause the hose to contact such supporting surface. In this connection it will be understood that the diameter of cylinder 12 should be only slightly smaller than the inside diameter of the hose 40 to minimize such hose sag.

The upper connector 44 may be any type of holding tank coupler while the lower connector 42 is normally a rigid plastic tube which merely fits into a sewage sump.

In the event that hose 40 does not contain, for example, lower connector 42, the hose 40 would slip down further on cylinder 12 and the locking ring 28 could then engage tabs 32' and 34' corresponding to tabs 32 and 34 hereinabove previously described.

A rubber stopper and hose coupling may be provided as an accessory to the holder in accord with this invention. Such stopper is used to temporarily close the top end of the cylinder after a disinfecting concentrated solution is poured therein and the water through the hose coupling will force water and disinfectant throughout the cylinder to move adequately to clean the sanitary hose as will be apparent to persons skilled in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A holder for cleaning and storing an elongated sanitary hose extensible between an extended length and a contracted length, said device comprising:

a. an elongated hollow cylinder having opposite ends and being of a length greater than the contracted length of such sanitary hose and having an outside diameter less than the inside diameter of such sanitary hose;

b. a retaining member mounted to said cylinder adjacent one of said ends and extending radially outwardly from said cylinder a distance whereby the combined outside diameter of said cylinder and the distance of said retaining member is greater than the inside diameter of such sanitary hose; and c. releasable means for locking such hose onto said cylinder adjacent the other of said ends of said cylinder.

2. The holder as defined in claim 1 wherein said one end is closed and said other end is open.

3. The holder as defined in claim 1 wherein said cylinder includes a plurality of spaced openings extending laterally therethrough.

4. The holder as defined in claim 1 wherein said retaining member includes a ring connected to said cylinder.

5. The holder as defined in claim 1 wherein said releasable means includes a ring and means for detachable securing said ring to said cylinder.

6. The holder as defined in claim 5 wherein said means for detachable securing includes a plurality of spaced tabs attached to and extending outwardly of said cylinder, said ring including a plurality of spaced notches corresponding in number to said tabs and being aligned therewith in one angular position, said notches passing over said tabs when aligned and upon angular rotation of said ring said tabs contact said ring to inhibit removal thereof.

7. The holder as defined in claim 6 wherein said ring includes a smaller notch adjacent its inner circumference, and wherein said means for detachable securing includes a smaller tab for locking within said smaller notch upon proper alignment therebetween.

8. The holder as defined in claim 6 wherein said ring is adapted to be moved in the direction of said retaining member to temporarily compress such hose therebetween and such hose biasing said ring in a direction to lock said ring smaller notch onto said smaller tab.

9. The holder as defined in claim 1, wherein said releasable means for locking comprises a locking ring having an outer circular surface and an inner circular surface and having a plurality of spaced vertical notches in the inner circular surface thereof, and a plurality of spaced stops, each said locking stop being rigidly mounted to said cylinder adjacent said other end of said cylinder and extending radially outwardly therefrom, said plurality of stops being arranged to be aligned with corresponding notches upon a proper rotative orientation between said ring and said cylinder.

10. The holder as defined in claim 1 wherein said retaining member includes a ring and said releasable means includes a ring, said rings having an outer diameter greater than the outer diameter of such hose whereby the holder may engage a surface with said rings being in contact therewith while inhibiting contact by such hose with such surface.

* * * * *